US011155985B2

(12) United States Patent
Ritger

(10) Patent No.: US 11,155,985 B2
(45) Date of Patent: Oct. 26, 2021

(54) MULTI-CHANNEL, LIGATION RESISTANT DRAIN COVER AND DRAIN ASSEMBLY

(71) Applicant: InPro Corporation, Muskego, WI (US)

(72) Inventor: Joshua A. Ritger, Waukesha, WI (US)

(73) Assignee: InPro Corporation, Muskego, WI (US)

( * ) Notice: Subject to any disclaimer, the term of this patent is extended or adjusted under 35 U.S.C. 154(b) by 0 days.

(21) Appl. No.: 16/790,424

(22) Filed: Feb. 13, 2020

(65) Prior Publication Data

US 2021/0254321 A1 Aug. 19, 2021

(51) Int. Cl.
*E03C 1/264* (2006.01)

(52) U.S. Cl.
CPC ..... *E03C 1/264* (2013.01)

(58) Field of Classification Search
CPC ..... E03C 1/264; E03C 1/26; E03C 1/262; A47K 1/14; E04H 4/1236; E03F 5/0407
USPC ..... 210/163; 4/292, 652, 679
See application file for complete search history.

(56) References Cited

U.S. PATENT DOCUMENTS 108,538 A * 10/1870 Walsh ..... E03C 1/2302 4/653
2,119,923 A * 6/1938 McIntyre ..... E03F 5/08 210/164
2,783,852 A * 3/1957 Sisk ..... E03F 5/0409 210/165
4,257,892 A * 3/1981 Boersma ..... E03F 5/0407 210/163
RE31,561 E * 4/1984 Thompson ..... E03C 1/26 4/286
5,759,414 A * 6/1998 Wilkes ..... E04H 4/1236 210/163
6,088,842 A * 7/2000 Barnett ..... E04H 4/1236 4/286
8,505,125 B1 * 8/2013 Chia ..... E03C 1/264 4/289
10,184,239 B2 * 1/2019 Meincke ..... E04C 2/421
2006/0219619 A1 * 10/2006 St-Cyr ..... E03F 5/06 210/232
2007/0034577 A1 * 2/2007 Bayard ..... E03F 5/06 210/767
2008/0271232 A1 * 11/2008 Self ..... E03C 1/264 4/292
2009/0007343 A1 * 1/2009 Houck ..... E03C 1/264 7/167
2010/0235982 A1 * 9/2010 Stimpson ..... E03F 5/0408 4/679

(Continued)

OTHER PUBLICATIONS

The Intersan Group, "CRR Drains, 303070XN/303077XN, Crocodile Roll Resistant Drain," Specification, 2 pages.

(Continued)

*Primary Examiner* — Benjamin R Shaw
(74) *Attorney, Agent, or Firm* — Reinhart Boerner Van Deuren s.c.

(57) ABSTRACT

A drain assembly for providing a drain passage for fluid flow from a surface to the drainpipe of a plumbing system. The surface would typically be that of a structure such as that of a floor, a floor of a shower or floor of a bathtub. The drain assembly includes a multi-channel cove wherein each flow channel is configured or curved in such a way to prevent the passage of a ligation (e.g., wire, cord, or rope) through the channels to allow the ligation to be tied to the cover.

20 Claims, 16 Drawing Sheets

(56) References Cited

U.S. PATENT DOCUMENTS

| | | | | |
|---|---|---|---|---|
| 2011/0154563 | A1* | 6/2011 | Ball | E03C 1/262 4/293 |
| 2012/0036631 | A1* | 2/2012 | Cook | E03F 5/0408 4/679 |
| 2012/0047643 | A1* | 3/2012 | Meyers | E03F 5/041 4/292 |
| 2014/0166560 | A1* | 6/2014 | Cohen | E03F 5/06 210/164 |
| 2018/0100298 | A1* | 4/2018 | Willburn | E03C 1/264 |
| 2020/0291631 | A1* | 9/2020 | Boeltl | E03C 1/26 |

OTHER PUBLICATIONS

Oatey, "Installation Instructions for Ligature Resistant Drain Cover in Oatey #42150 Shower Drain," 2 pages.
Whitehall Manufacturing, "Ligature Resistant Floor Drain Grate," Aug. 4, 20218, 1 page.
Whitehall Manufacturing, "Ligature Resistant No-Caulk Shower Drain," Aug. 13, 2019, 1 page.
Tower Surfaces, "Ligature Resistant Shower Drain Cover," 2 pages.
Oatey, "140 Series / 101 PNC Series Brass and Plastic No-Calk Shower Drain," Oct. 2005, 1 page.

* cited by examiner

MULTI-CHANNEL, LIGATION RESISTANT DRAIN COVER AND DRAIN ASSEMBLY

BACKGROUND OF THE INVENTION

The present invention relates to ligation resistant drain, including a drain cover and associated drain assembly for use as a floor drain, sink drain, shower drain, bathtub drain, etc. In particular, the cover and assembly resist the ability to tie a ligation such as a wire, rope, string, shoelace, etc. through the fluid flow openings in the drain cover. Additionally, the drain includes separated fluid flow pathways that aid in the venting of the drain to facilitate fluid flow through the drain and cover assembly.

SUMMARY OF THE INVENTION

One embodiment of the present invention provides for a multi-channel, ligation resistant drain cover having a top side and a bottom side. The cover includes a top plate including a top surface, a bottom surface, a periphery, a first interior fluid flow opening extending between the top and bottom surface, and a first exterior fluid flow opening extending between the top and bottom surface and located between the interior fluid flow opening and the periphery. An exterior fluid guide wall extends from the bottom surface between the periphery and the exterior fluid flow opening. The exterior fluid guide wall includes a first diverter wall displaced from the bottom surface and extending at a first angle from the exterior fluid guide wall. An intermediate fluid guide wall extends from the bottom surface between the interior and exterior flow openings and includes a second diverter wall displaced from the bottom surface and extending at a second angle from the intermediate fluid guide wall. The exterior and intermediate fluid guide walls are located to form a curved exterior fluid flow channel extending from the top surface, through the exterior fluid flow opening and exiting at the bottom side of the cover at an exterior exit. An interior fluid guide wall extends from the bottom surface and cooperates with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit.

Another embodiment of the present invention provides for a multi-channel, ligation resistant drain assembly. The assembly includes an interface for creating a sealed fluid channel between a flow and drain pipe. The interface includes a flange for attachment to a floor surface which is joined to a tubular portion for attachment to a drain pipe. A drain cover is attached to the inlet of the interface. The cover includes a top plate including a top surface, a bottom surface, a periphery, a first interior fluid flow opening extending between the top and bottom surface, and a first exterior fluid flow opening extending between the top and bottom surface and located between the interior fluid flow opening and the periphery. An exterior fluid guide wall extends from the bottom surface between the periphery and the exterior fluid flow opening. The exterior fluid guide wall includes a first diverter wall displaced from the bottom surface and extending at a first angle from the exterior fluid guide wall. An intermediate fluid guide wall extends from the bottom surface between the interior and exterior flow openings and includes a second diverter wall displaced from the bottom surface and extending at a second angle from the intermediate fluid guide wall. The exterior and intermediate fluid guide walls are located to form a curved exterior fluid flow channel extending from the top surface, through the exterior fluid flow opening and exiting at the bottom side of the cover at an exterior exit. An interior fluid guide wall extends from the bottom surface and cooperates with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit.

Still another embodiment of the present invention provides for a multi-channel, ligation resistant drain cover. The cover includes a circular top plate including a top surface, a bottom surface, a periphery, three interior fluid flow openings extending between the top and bottom surface, and three exterior fluid flow openings extending between the top and bottom surface and located between the interior fluid flow opening and the periphery. An exterior fluid guide wall extends from the bottom surface between the periphery and the exterior fluid flow openings and includes a first diverter wall displaced from the bottom surface and extending at a first angle from the exterior fluid guide wall. An intermediate fluid guide wall extends from the bottom surface between the interior and exterior flow openings and includes a second diverter wall displaced from the bottom surface and extending at a second angle from the intermediate fluid guide wall. The exterior and intermediate fluid guide walls are located to form a curved exterior fluid flow channel extending from the top surface, through the exterior fluid flow openings and exiting at the bottom side of the cover at an exterior exit. An interior fluid guide wall extends from the bottom surface and cooperates with the intermediate fluid guide wall to form a curved interior fluid flow channel separate from the exterior fluid flow channel and extending from the top surface, through the interior fluid flow openings and exiting at the bottom side of the cover at an interior exit separate from and displaced from the exterior exit. Three interior dividing walls extend between the intermediate fluid guide wall and the interior fluid guide wall to form three separate interior flow paths through the interior fluid flow channel associated with each of the interior flow openings. Three exterior dividing walls extend between the intermediate fluid guide wall and the exterior fluid guide wall to form three separate exterior flow paths through the exterior fluid flow channel associated with each of the exterior flow openings.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
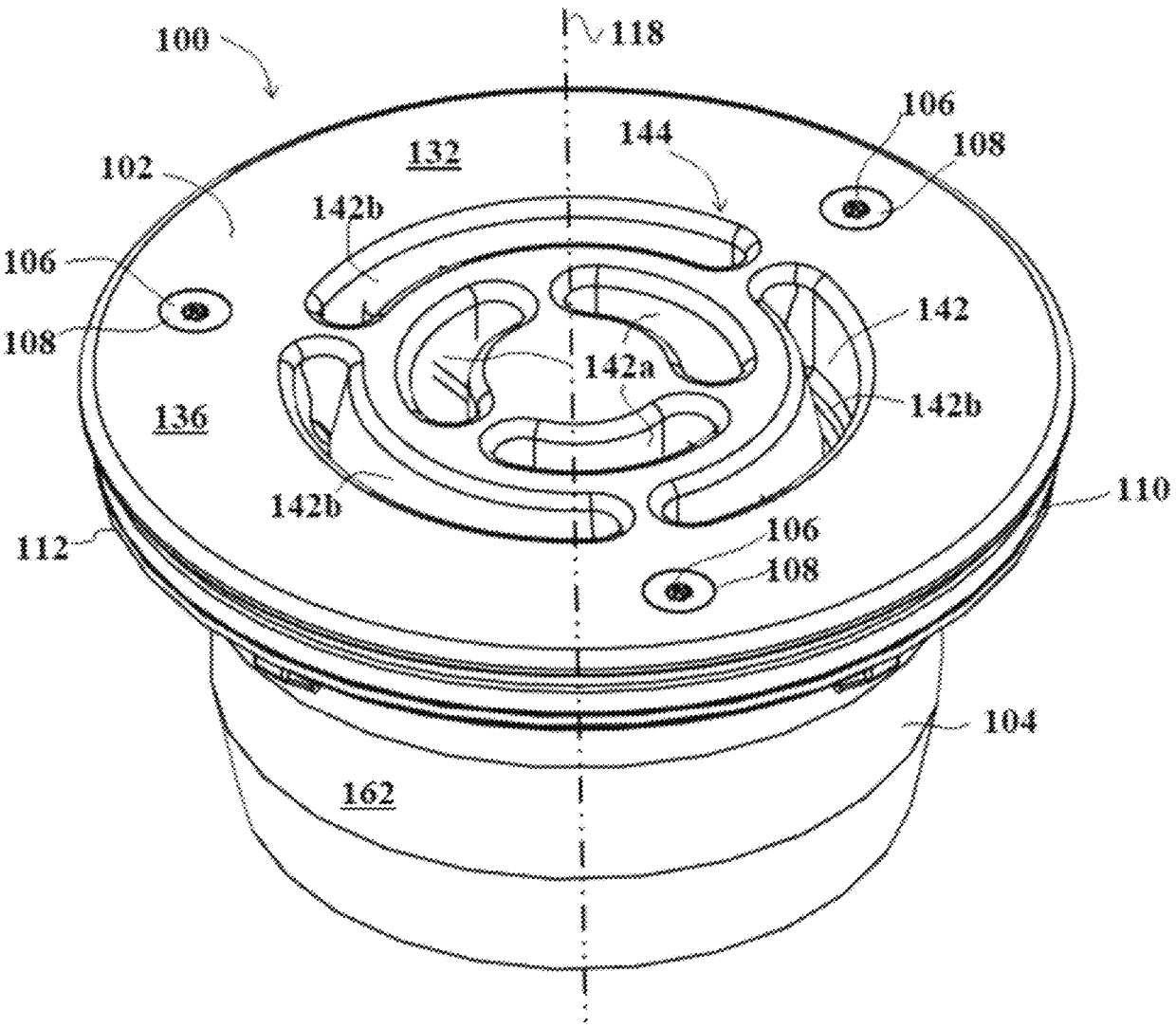
FIG. 1 is a perspective view of a ligation resistant drain assembly.

FIG. 1 illustrates a perspective view of a multi-channel ligation resistant drain assembly 100, according to an exemplary embodiment. Drain assembly 100 includes a multi-channel ligation resistant strainer or drain cover 102 coupled to a drain body 104 with one or more tamper-resistant flat head screws 106 through fastener holes or locations 108 of cover 102 and anchoring into threaded nuts or inserts 109 in drain body flange 130. In one embodiment, screws 106 include a head configured with six or more points in a star-shaped pattern enhance tamper resistance. A washer-shaped rubber seal or washer 110 and/or a fiber washer 112 to couple the drain body 104 to an underside of the floor. Drain body 104 forms a bridge to existing piping (e.g., interchangeably forms a fluid-tight seal with PVC, steel, copper, or other plumbing). A rubber sleeve 114 bridges drain body 104 over the joint to seal the connection.

Similarly, a clamping ring or compression nut 116 outside drain body 104 fastens drain body 104 to the floor. In some embodiments, drain assembly 100 is circular and defined radially from a central axis 118. In some embodiments, cover 102 is a single integral or unitary part formed from casting, for example, a cast steel, such as a stainless steel casting.

Figure 2:
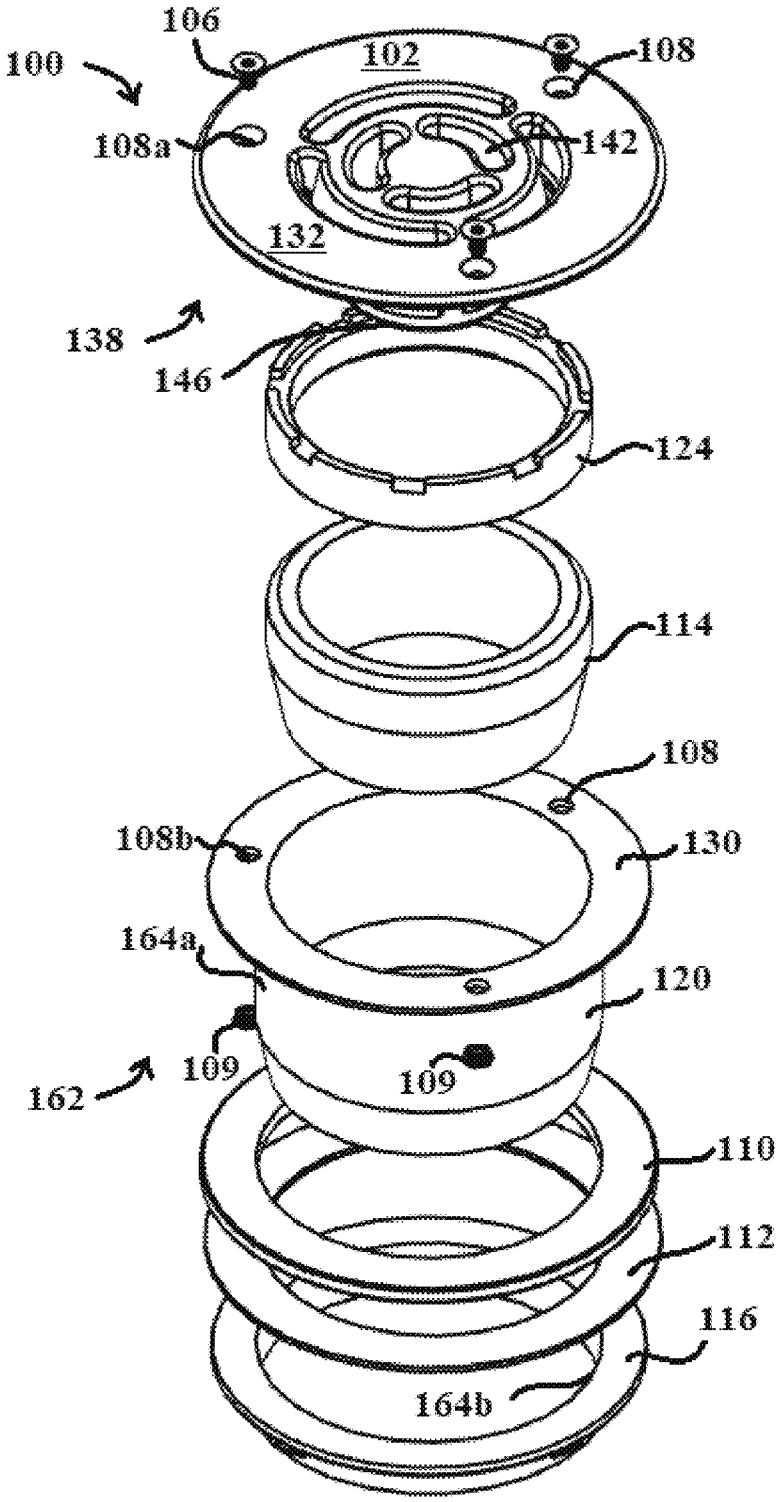
FIG. 2 is an exploded perspective view of the assembly.

FIG. 2 shows an exploded perspective view of the drain assembly 100 of FIG. 1. Cover 102 couples to drain body 104 via screws 106. Rubber washer 110 extends around tubular portion 120 and is captured between the floor and fiber washer 112. Fiber washer 112 is captured between rubber washer 110 and compression nut 116. Compression nut 116 secures the drain body 104 to the floor. Internal compression ring 124 presses downward on rubber sleeve 114 to seal the joint between drain assembly 100 and the existing drain pipe. Internal compression ring 124 and rubber sleeve 114 cooperate to capture and/or secure the pipe within drain assembly 100.

Figure 3:
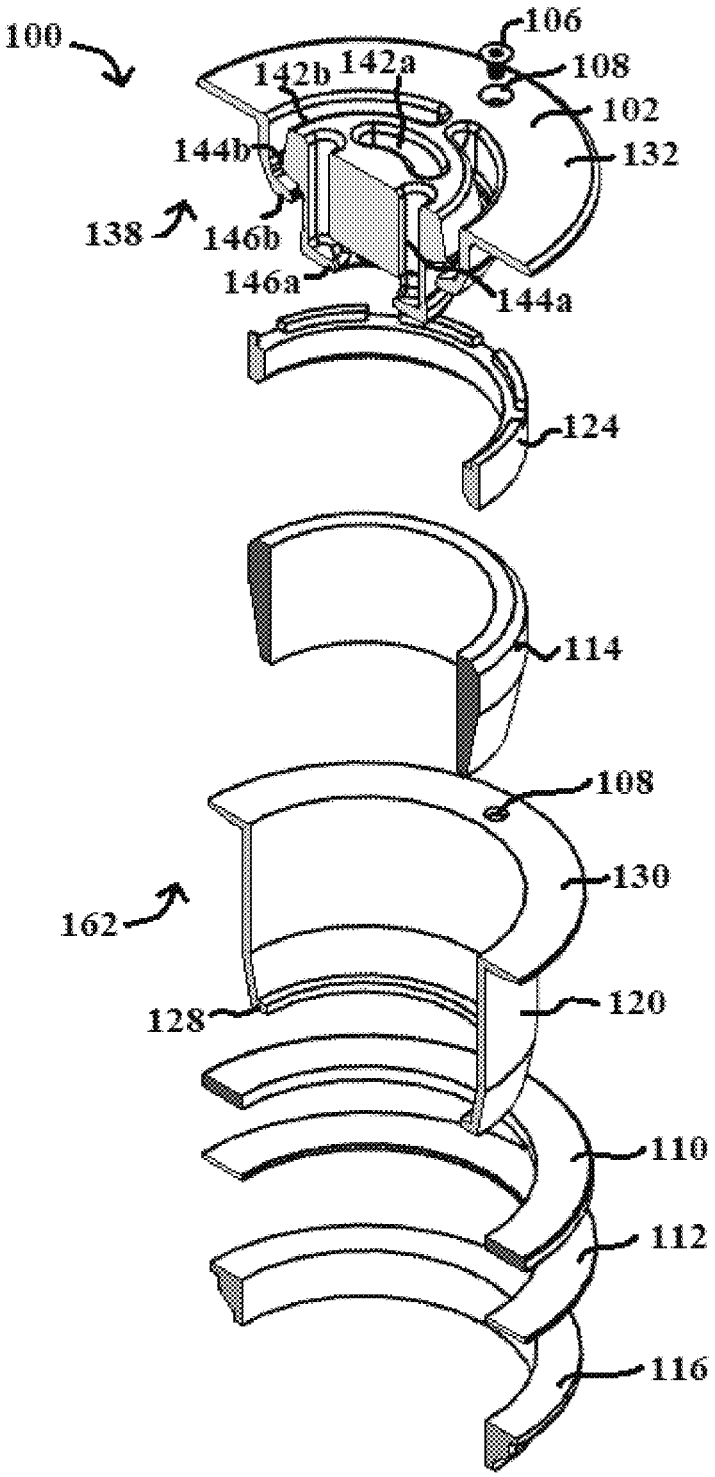
FIG. 3 is an exploded, perspective, sectional view of the assembly.

FIG. 3 is a cross-sectional view and better illustrates the cooperation of internal compression ring 124 and rubber sleeve 114 to seal drain body 104 to existing pipe installation. Rubber sleeve 114 fits under internal compression ring 124 to bridge the joint between drain body 104 and the existing pipe. Bottom of drain body 104 may include a lip 128 that cooperates or couples to rubber sleeve 114 to retain sleeve 114 within drain body 104. Similarly, an upper flange 130 of drain body 104 may be configured to couple to cover 102.

Figure 4:
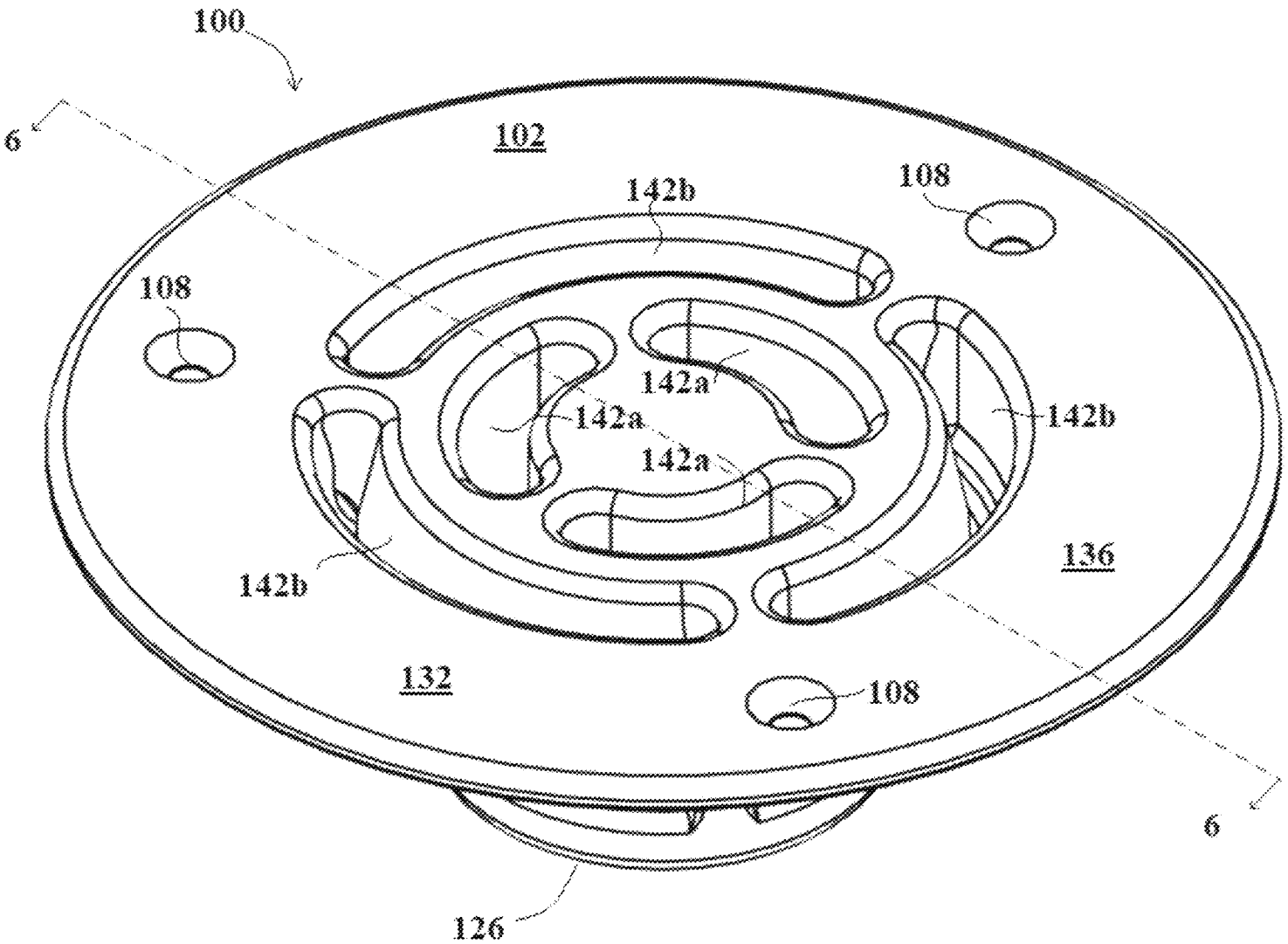
FIG. 4 is a top perspective view of the drain cover of the assembly.
Figure 5:
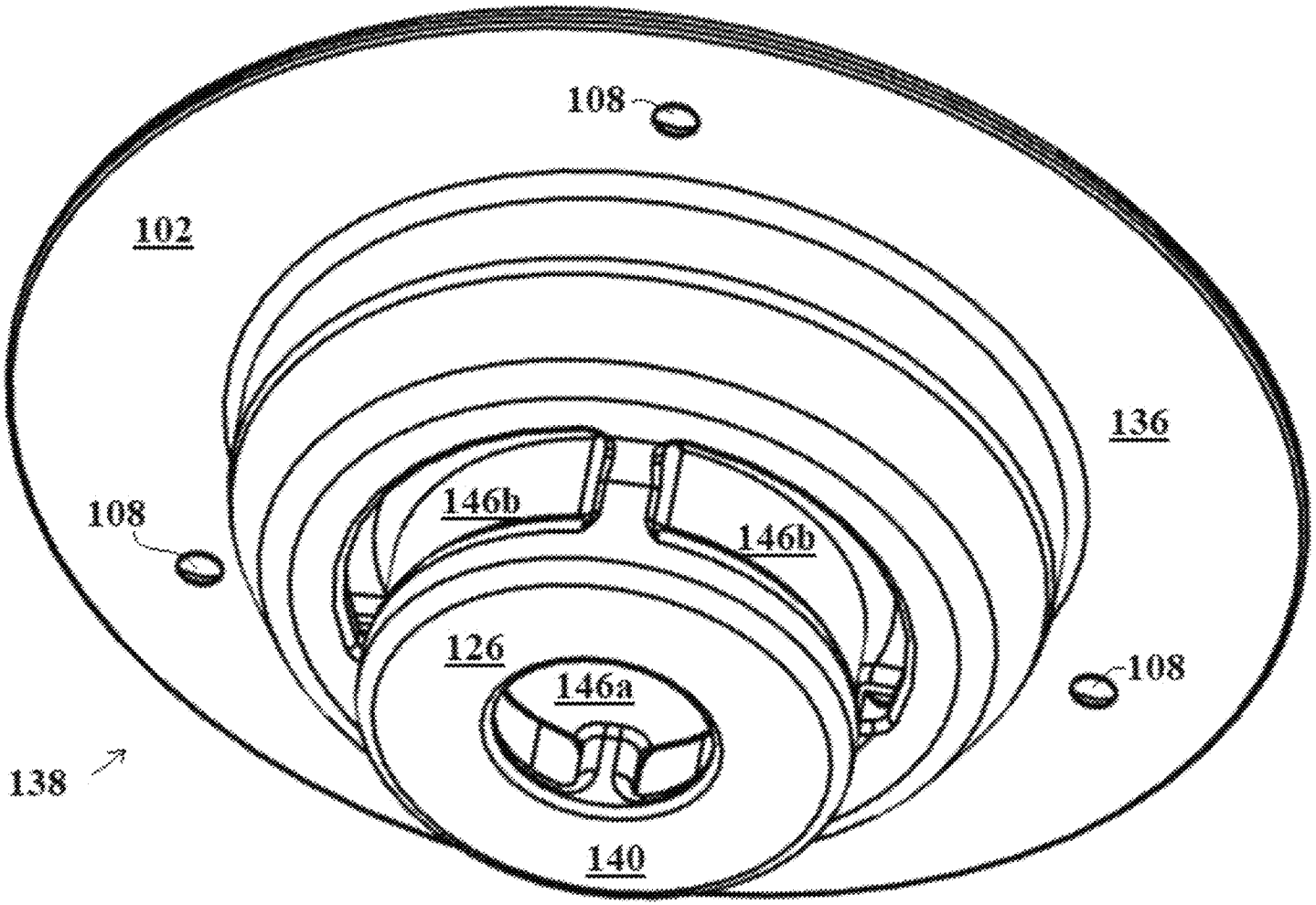
FIG. 5 is a bottom perspective view of the drain cover of the assembly.

With reference to FIGS. 4 and 5, ligation resistant drain cover 102 has an upper side or top surface 132 (FIG. 4) and a bottom 126 (FIG. 5). Cover 102 forms a disk or plate 136 that defines top surface 132, e.g., on a top side of plate 136. Cover 102 has a radially extending side profile about central axis 118 that forms a periphery 138. In some embodiments, plate 136 is circular, and periphery 138 is defined radially about central axis 118 (FIG. 1). Bottom 126 defines a bottom surface 140. Fluid flow openings 142 on top surface 132 lead to channels 144 that extend through cover 102 to communicate fluid from top surface 132 to bottom surface 140, e.g., like a drain. In various embodiments, channels 144 are angled, curved, terminate at different locations, and/or are not in fluid communication with adjacent channels 144 to enhance the ligation resistance of cover 102.

For example, interior and exterior fluid flow openings $\mathbf{142}_a$ and $\mathbf{142}_b$ communicate through cover 102 between top surface 132 and bottom surface 140 via interior and exterior channels $\mathbf{144}_a$ and $\mathbf{144}_b$, respectively. Fluid, such as water, enters cover 102 in either interior or exterior fluid flow openings $\mathbf{142}_a$ or $\mathbf{142}_b$ on top surface 132, passes through the respective interior or exterior channel $\mathbf{144}_a$ or $\mathbf{144}_b$ and exits through an interior or exterior exit $\mathbf{146}_a$ or $\mathbf{146}_b$, respectively. In other words, fluids that enter opening 142 pass through a corresponding channel 144 of cover 102 to an exit 146 on or near bottom surface 140. In some embodiments, interior channel $\mathbf{144}_a$ vent drain cover 102 as exterior channel $\mathbf{144}_b$ receives the drained liquid.

Exterior flow opening $\mathbf{142}_b$ is located between interior fluid flow opening $\mathbf{142}_a$ and periphery 138 and forms a separate exterior fluid channel $\mathbf{144}_b$ that is not in communication with interior fluid channel $\mathbf{144}_a$. Applicant has found that this configuration enhances ligation resistance by preventing the coupling of opposite ends of a rope (e.g., a shoelace) and prevents modification or alteration of drain cover 102 by a user.

Figure 6:
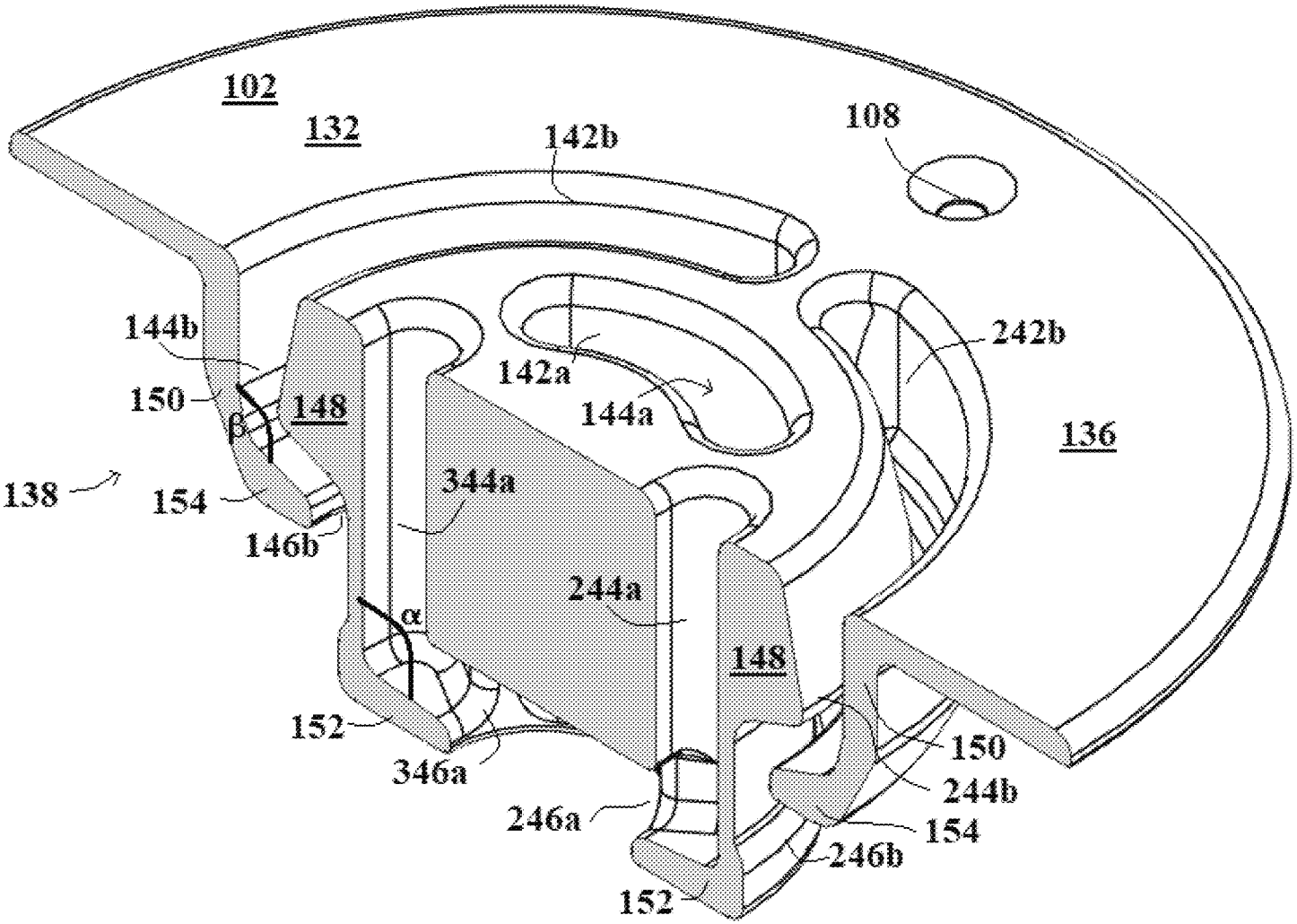
FIG. 6 is a perspective sectional view of the ligation resistant drain cover of the assembly taken along line 6-6 of FIG. 4.

In some embodiments, interior opening $\mathbf{142}_a$ and exterior opening $\mathbf{142}_b$ are displaced and/or angled relative to one another. Similarly, interior and/or exterior channels $\mathbf{144}_a$ and/or $\mathbf{144}_b$ may be curved, angled, and/or terminate or end in different locations to enhance ligation resistance. For example, as shown in FIG. 6, an intermediate fluid guide wall 148 and an exterior fluid guide wall 150 define curvilinear boundaries for interior and exterior channels $\mathbf{144}_a$ and $\mathbf{144}_b$. As shown in FIG. 6, exterior exit $\mathbf{146}_b$ is elevated from interior exit $\mathbf{146}_a$.

Intermediate fluid guide wall 148 extends from a bottom of plate 136 between interior and exterior flow openings $\mathbf{142}_a$ and $\mathbf{142}_b$ and terminates at an interior diverter wall 152. Interior diverter wall 152 is displaced from bottom surface 140 and extends at an angle $\alpha$ from intermediate fluid guide wall 148. Intermediate fluid guide wall 148 extends from plate 136 to form a curved interior fluid flow passage, or interior channel $\mathbf{144}_a$, which is separate from exterior fluid flow channel $\mathbf{144}_b$.

Similarly, exterior fluid guide wall 150 extends from a bottom surface of plate 136 between periphery 138 and exterior fluid flow opening $\mathbf{142}_b$. Exterior fluid guide wall 150 terminates at an exterior diverter wall 154 that is displaced or offset from bottom surface 140. Exterior diverter wall 154 extends at an angle $\theta$ from exterior fluid guide wall 150 to define an exit angle, e.g., of a fluid or an inserted rope exiting drain 102 at exterior exit $\mathbf{146}_b$.

Intermediate and exterior fluid guide walls 148 and 150 are located to form a curved exterior fluid flow channel, or exterior channel $\mathbf{144}_b$ that extends from top surface 132, through exterior fluid flow opening $\mathbf{142}_b$ and exits on the bottom surface 140 of cover 102 at interior and exterior exits $\mathbf{146}_a$ and $\mathbf{146}_b$, respectively. Intermediate and/or exterior guide walls 148 and/or 146 can be radially defined from central axis 118 to include respective cylindrical portions and/or cylindrical or circular interior and/or exterior diverter walls 152 and/or 154. In some embodiments, deflectors or diverters formed by diverter walls 152 and 150 are washer shaped.

In various embodiments, angle $\alpha$ is between 80° and 120°, specifically, between 90° and 110°, and more specifically 100°, such that interior diverter wall 152 is parallel with plate 136. Similarly, in various embodiments, angle $\beta$ is between 90° and 130°, specifically, between 100° and 120°, and more specifically 110°, such that exterior diverter wall 154 is parallel with plate 136. In these embodiments, for example, exterior diverter wall 154 is angled in such a way that a rope inserted into exterior channel $\mathbf{144}_b$ exits in a direction (e.g., angle (3) that is different from a direction (e.g., angle $\alpha$) a rope inserted into interior channel $\mathbf{144}_a$ exits. In this way, interior and exterior diverter walls 152 and 154 enhance ligation resistance.

Figure 9:
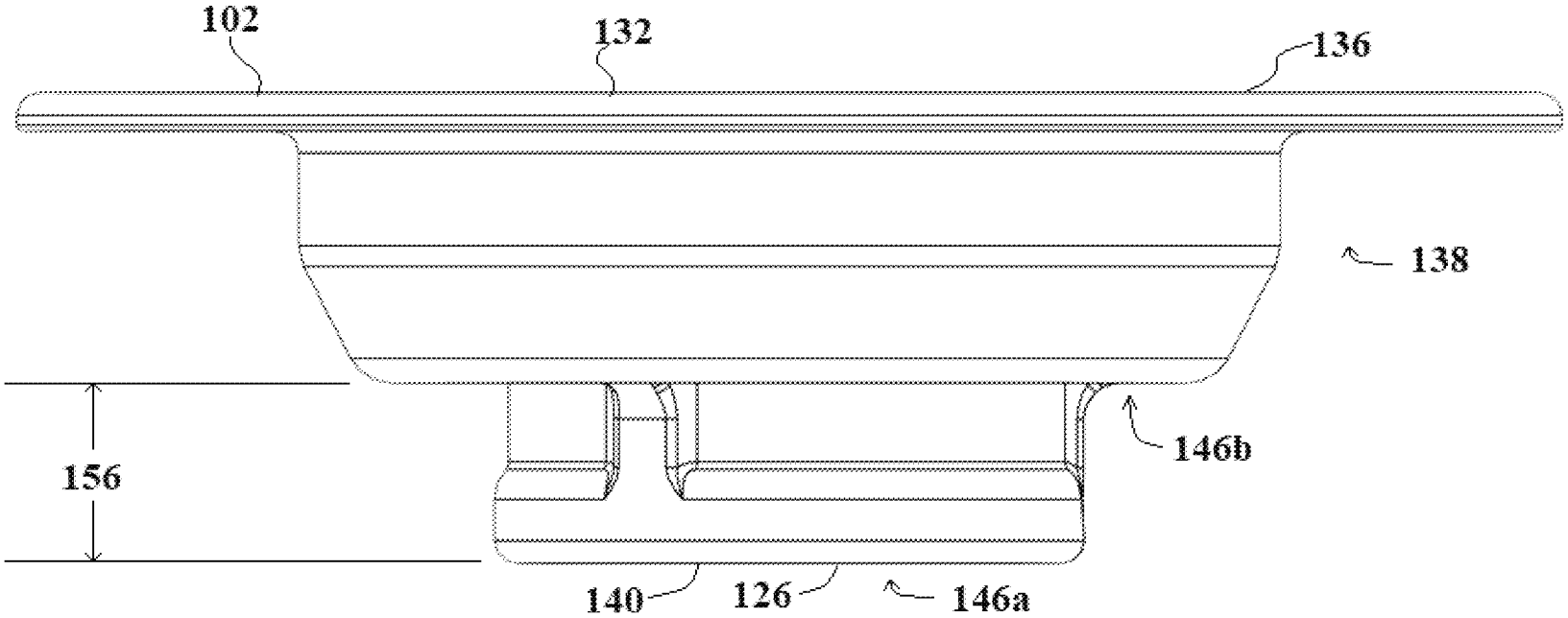
FIG. 9 is a side view of the drain cover.
Figure 10:
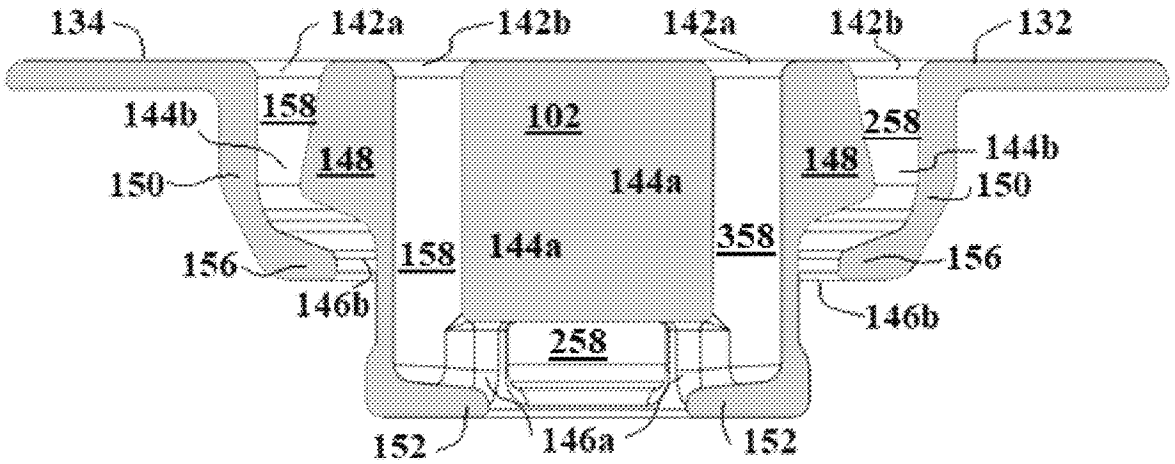
FIG. 10 is a side sectional view of the drain cover taken along line 10-10 of FIG. 7.
Figure 11:
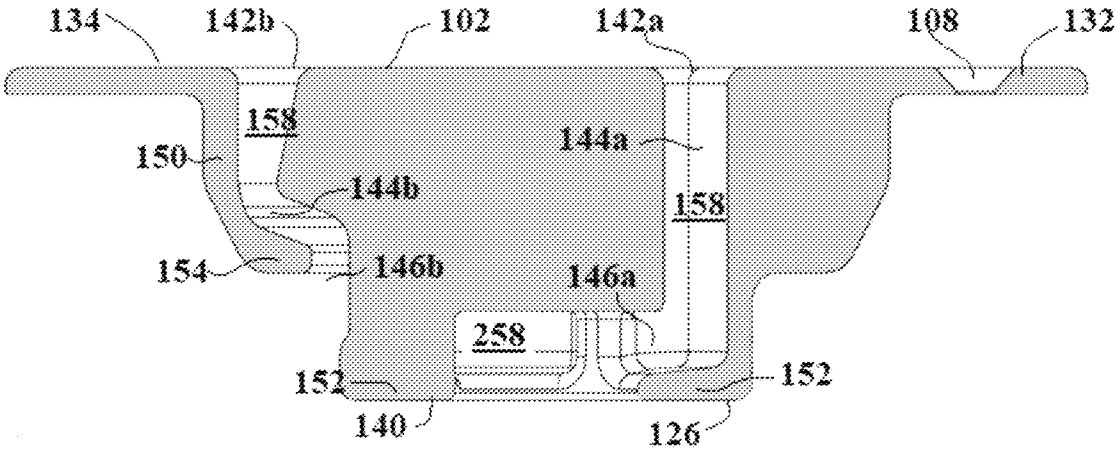
FIG. 11 is a side sectional view of the drain cover taken along line 11-11 of FIG. 7.

Interior channel $\mathbf{144}_a$ extends from top surface 132, through interior fluid flow opening $\mathbf{142}_a$ and exits on the bottom side of cover 102 at an interior exit $\mathbf{146}_a$. Interior exit $\mathbf{146}_a$ is separate from and displaced from exterior exit $\mathbf{146}_b$. Similarly, interior channel $\mathbf{144}_a$ is separate from and not in fluid communication with exterior channel $\mathbf{144}_b$ to enhance ligation resistance. In some embodiments, interior exit $\mathbf{146}_a$ is located further from the bottom surface 140 than exterior exit $\mathbf{146}_b$, for example, because interior channel $\mathbf{144}_a$ is longer than exterior channel $\mathbf{144}_b$. In some embodiments, interior diverter wall 152 is displaced from exterior diverter wall 154 such that an offset 156 (FIG. 9) exists between interior diverter wall 152 and exterior diverter wall 154. For example, interior exit $\mathbf{146}_a$ is located further from the bottom surface 140 than exterior exit $\mathbf{146}_b$. In various embodiments, offset 156 is less than 2 inches, specifically less than 1 inch, and more specifically less than 0.5 inches. In various embodiments, offset 156 is between 0.25 inches and 1 inch, specifically between 0.4 inches and 0.75 inches, and, more specifically, is 0.50±0.05 inches.

Figure 7:
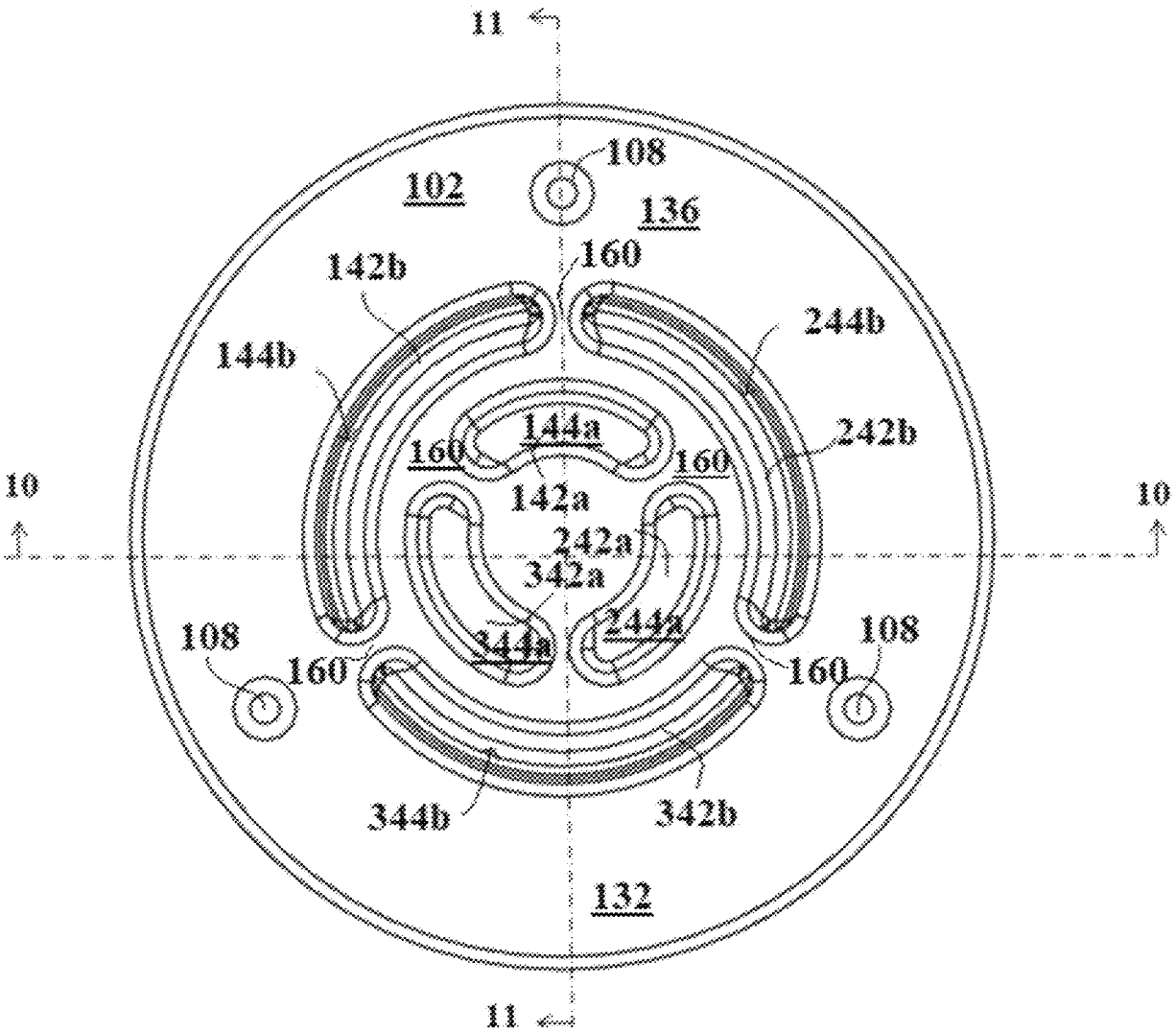
FIG. 7 is a top view of the drain cover.
Figure 8:
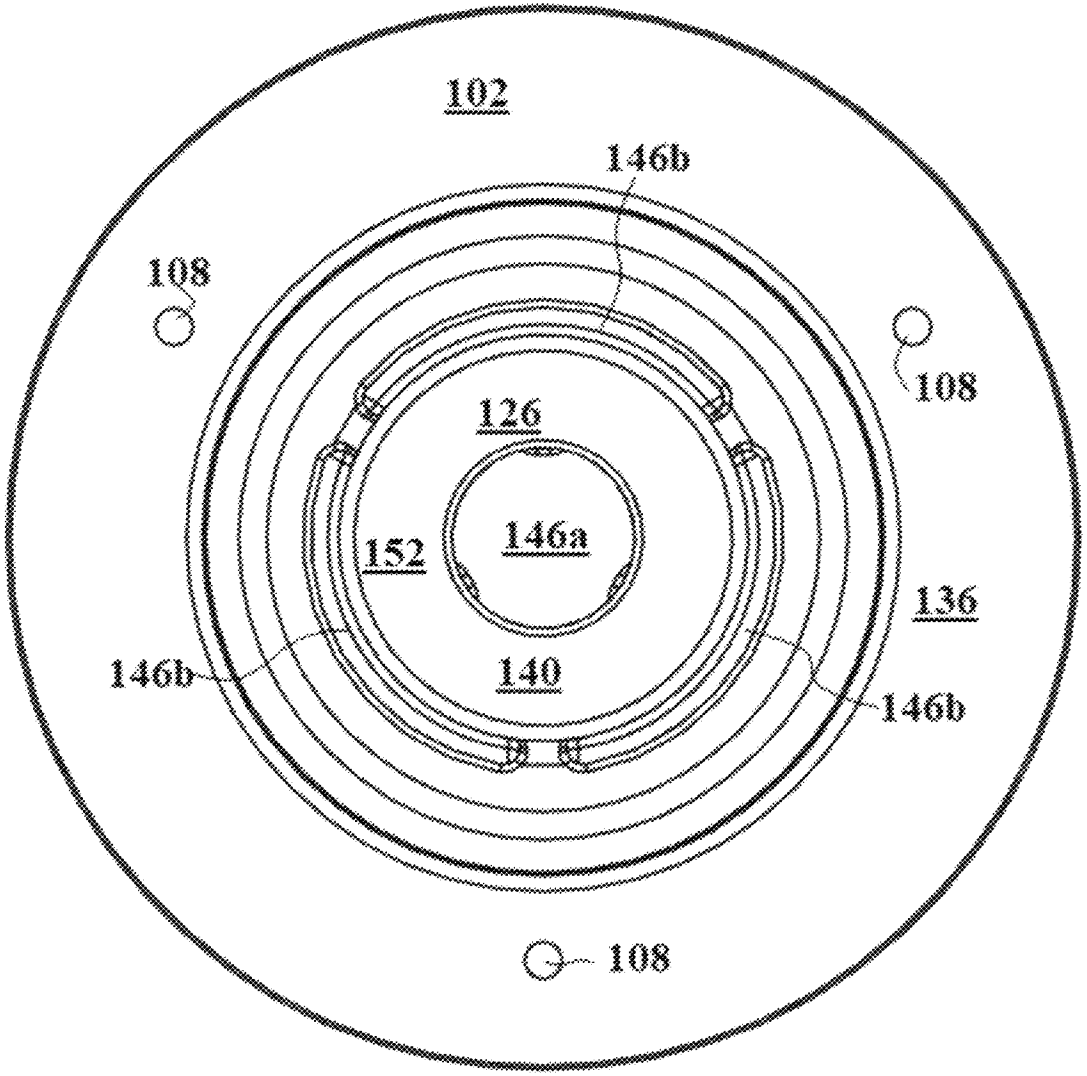
FIG. 8 is a bottom view of the drain cover.

FIG. 7 shows another embodiment with additional channels 144 and/or walls 160. In general, reference is made to openings 142, channels 144, and exits 146, but additional independent openings 242 and/or 342, independent channels 244 and/or 344, and independent exits 246 and/or 346 may be used on drain cover 102 to generate additional independent flow paths 158 and thus increase ligation resistance. Flow paths 158 are voids or spaces in cover 102 that include openings 142, channels 144, and exits 146 and are independent and separate from other flow paths 158. For example, two channels 144 may be in fluid communication and thus only define one flow path 158. In other words, a single flow path 158 may have any combination of openings 142, channels 144, and exits 146 that are all in fluid communication with one another.

In various embodiments, two or three independent flow paths 158 can be defined through cover 102. In some embodiments, each flow opening 142 defines a unique flow path 158 through a unique channel 144 and exit 146. In other words, water that enters a first flow path 158 would enter through opening 142, pass through channel 144, and exit through exit 146. Similarly, second and or third flow paths 258 and 358 are envisioned. For example, a second flow path 258 may include a second interior flow opening 242*a* that is in fluid communication with a second channel $\mathbf{244}_a$ and a second exit $\mathbf{246}_a$. Similarly, a third flow path 358 may include a third flow opening $\mathbf{342}_a$ that communicates with third channel $\mathbf{344}_a$ and third exit $\mathbf{346}_a$. Since each flow path 158, 258, and 358 is independent and separate, additional interior dividing walls 160 (e.g., two or three) extend between intermediate fluid guide wall 148 and intermediate fluid guide wall 148 form separate interior flow paths 158, 258, and 358. In other words, dividing walls 160 separate interior fluid flow channels 144, 244, and 344. Each flow path 158, 258, and 358 is independent and associated with one of the interior flow openings $\mathbf{142}_a$, 242*a*, or $\mathbf{342}_a$, and one of the interior exits $\mathbf{146}_a$, $\mathbf{246}_a$, or $\mathbf{346}_a$.

Similar to the interior flow paths 158, exterior flow paths 158 may be independent and separate. For example, a first exterior opening $\mathbf{142}_b$ communicates with a first exterior channel $\mathbf{144}_b$ that exits at a first exterior exit $\mathbf{146}_b$. A second exterior flow opening $\mathbf{242}_b$ and/or third exterior flow opening $\mathbf{342}_b$ can be added with corresponding second and/or third exterior channels $\mathbf{244}_b$ and/or $\mathbf{344}_b$ and second and/or third exterior exits $\mathbf{246}_b$ and/or $\mathbf{346}_b$.

In a multiple flow path 158 configurations, channels 244 and/or 344 are the same as or similar to channel 144 except for the differences described. In contrast to channel 144, channels 244 and/or 344 have independent flow paths 158 that are not in fluid communication with any other channel 144, 244, or 344. Similar differences exist for openings 142, 242, and 342, as well as exits 146, 246, and 346. In this configuration, cover 102 has two exterior dividing walls 160 that extend between intermediate fluid guide wall 148 and exterior fluid guide wall 150 to form two separate exterior flow paths 158 through the exterior fluid flow channel $\mathbf{144}_b$, $\mathbf{244}_b$, and $\mathbf{344}_b$. Each flow path 158, 258, and 358 is independent and associated with one of the exterior flow openings $\mathbf{142}_b$, $\mathbf{242}_b$, and $\mathbf{342}_b$.

Drain assembly 100 and/or cover 102 can be configured as a new installation or as an improvement on an existing installation. Drain assembly 100 for a new or an existing installation may use the same components described above or may incorporate some or all of the differences described below.

In some embodiments, drain assembly 100 has an interface 162 (FIGS. 1 and 2) that creates a sealed fluid channel 144 between a flow source and a drain pipe to replace an existing drain (e.g., a channel 144 from top surface 132 to bottom surface 140 of cover 102). Interface 162 is made from a suitable plumbing material, such as PVC, brass, and/or copper. The drain cover 102 interface 162 has flange 130 configured for attachment to a surface of a floor. Flange 130 couples to the surface (e.g., directly to the floor) to join a tubular portion 120 to the existing drain pipe. In some embodiments, drain cover 102 has fastener locations 108 to fit a conventional drain. For example, with reference to FIG. 2, tamper resistant screws 106 and/or tamper resistant nuts or inserts 109 are disposed at fastener locations $\mathbf{108}_a$ on drain cover 102 and through fastener locations $\mathbf{108}_b$ on flange 130 to couple with inserts 109 and secure a new or pre-existing drain installation.

In some embodiments, a plurality of tamper-resistant flat head screws 106 are inserted at a plurality of counter-sunk fastener hole locations 108 of cover 102. Screws 106 are anchored at a plurality of threaded inserts 109 in a drain body 104 flange 130. Tamper-resistant flat head screws 106 may be chamfered as shown to fit in the counter-sunk locations 108 and anchor in threaded inserts 109 of flange 130. Inserts 109 can be new (e.g., with a new drain installation) or pre-installed (e.g., with a pre-existing installation). For example, cover 102 includes fastener locations 108 that are retrofit for an existing drain body 104 installation. Specifically, the illustrated embodiment shows at least three screws 106 inserted into at least three locations 108 on cover 102. Screws 106 anchor in three inserts 109 on drain body 104 and/or flange 130.

Drain assembly 100 may include a threaded clamping ring, the same as or similar to internal compression ring 124. In contrast to the internal compression ring 124 described above, threaded compression or compression nut 116 couples with exterior tubular portion 120 that includes external threads $164_a$ configured to be engaged with internal threads $164_b$ of compression nut 116 and fasten drain assembly 100 to a floor. In this configuration, tubular portion 120 of drain assembly 100 couples to the existing installation by capturing a portion of the floor between flange 130 and threaded compression nut 116.

Figure 12:
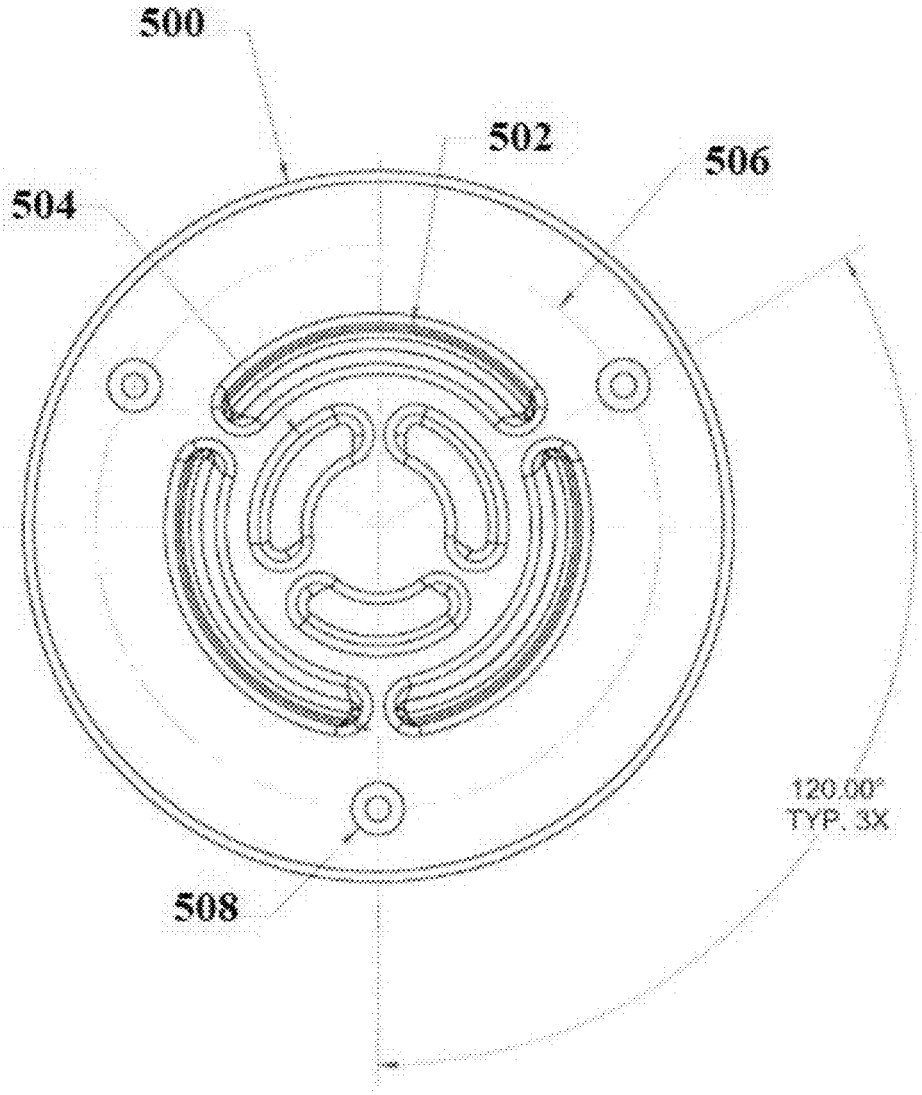
FIG. 12 is an isometric top view of the drain cover.

FIG. 12 shows various dimensions of drain cover 102, according to an exemplary embodiment. In various embodiments, an outer diameter 500 of cover 102 is between 4 inches and 4.5 inches, specifically between 4.2 inches and 4.3 inches, and more specifically, is 4.25 inches with a tolerance of +0.00 and −0.03. An external opening drain diameter 502 of exterior openings $142_b$ is between 2.25 inches and 2.75 inches, specifically between 2.3 inches and 2.5 inches, and more specifically, is 2.43 inches±0.10 inches. An internal drain diameter 504 of internal openings $142_a$ is between 1.25 inches and 1.75 inches, specifically between 1.4 inches and 1.5 inches, and, more specifically, is 1.43 inches±0.10 inches. This orientation is designed to enhance ligation resistance by providing adequate spacing between exits $146_a$ and $146_b$ to prevent tying opposite ends of a rope through cover 102.

In some embodiments, three fastener locations 108 are spaced on a fastener diameter 506 between 3.25 and 3.5 inches, specifically 3.38±0.1 inches. As shown, fastener locations 108 are evenly spaced, e.g., at approximately 120°. Similarly, four fastener holes may be used and spaced at approximately 90°. In some embodiments, spacing and/or locations of fastener holes may follow customary drain fitting dimensions so that cover 102 can be retrofitted to an existing drain installation. In some embodiments, countersunk fastener locations 108 are used to prevent manipulation of screws 106 after installation. For example, a shank diameter of 0.10 to 0.20 inches can have a countersink between 80° and 90°. Specifically, a shank diameter 508 of 0.15±0.03 inches with a countersink of 82.00°±2.00° may have a countersink diameter 508 of between 0.25 inches and 0.35 inches, and, more specifically, 0.31±0.03 inches.

Figure 13:
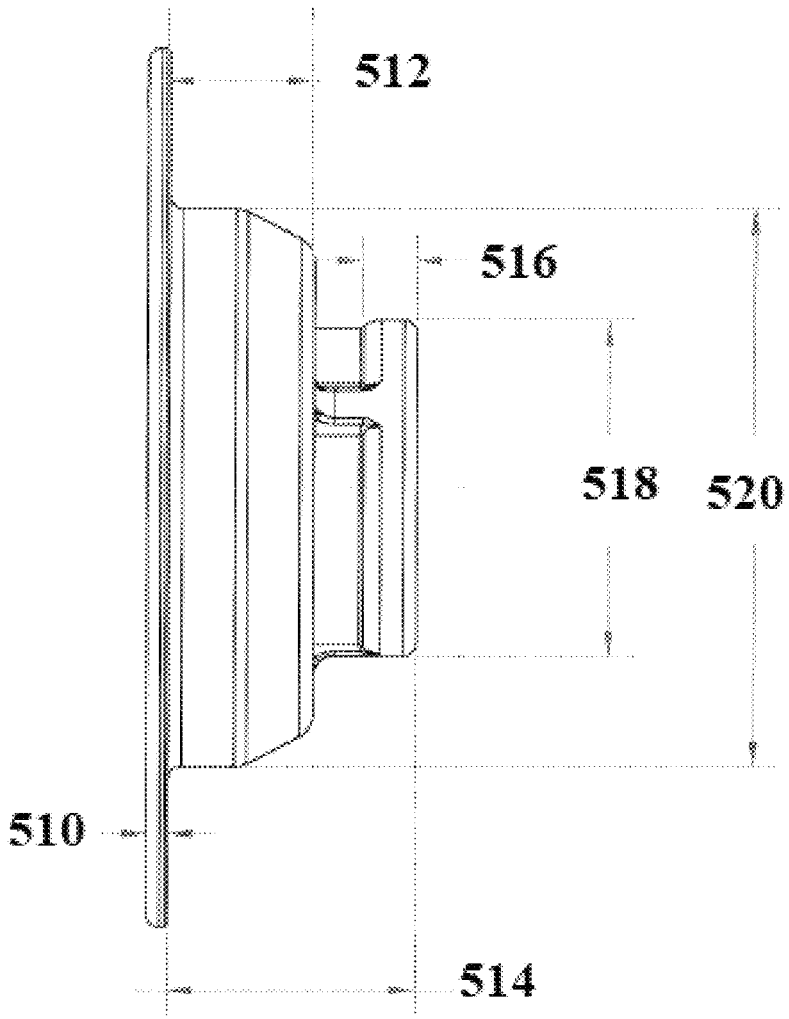
FIG. 13 is an isometric side view of the drain cover.

FIG. 13 is an isometric side view of drain cover 102, according to an exemplary embodiment. A thickness 510 of top plate 136 is shown to be between 0.07 inches and 0.15 inches, specifically 0.11 inches. A length 512 from a bottom of plate 136 to exterior diverter wall 154 is between 0.5 inches and 1 inch, specifically between 0.60 inches and 0.80 inches, and more specifically, is 0.70 inches±0.05 inches. A length 514 from the bottom of plate 136 to interior diverter wall 152 is between 0.75 inches and 2 inches, specifically between 1 inch and 1.5 inches, and, more specifically, is 1.2±0.1 inches. For example, length 512 is 0.70±0.05 inches, and offset 156 is 0.5±0.05 inches for a total length 514 of 1.2±0.1 inches. Applicant has found that these dimensions enhance ligation resistance by increasing offset 156 while also not interfering with other dimensions of drain assembly 100.

FIG. 13 shows a curved deflector or interior diverter wall 152 with a wall thickness 516 of between 0.15 inches and 0.4 inches, specifically between 0.2 inches and 0.3 inches, and more specifically, 0.27 inches±0.03 inches. An outer diameter or width 518 of interior channels $144_a$ is between 1.25 inches and 1.75 inches, specifically between 1.5 inches and 1.7 inches, and, more specifically, is 1.63±0.05 inches. Similarly, an outer diameter 520 of exterior channels $144_b$ is between 2.5 inches and 3 inches, specifically between 2.6 inches and 2.8 inches, and more specifically, is 2.70 inches±0.05 inches. Lengths 512 and 514, as well as widths 518 and 520, enable placement of curvilinear channels $144_a$ and $144_b$ within cover 102. Similarly, diverter wall thickness 516 enables a curvilinear exit 146 from either channel 144.

Figure 14:
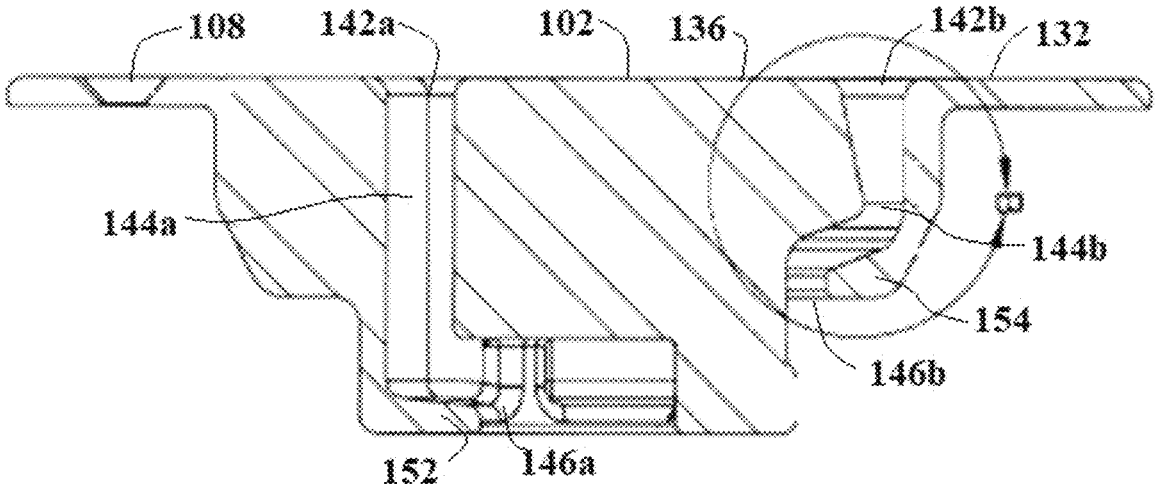
FIG. 14 is a cross-sectional side view taken along line 11-11 of FIG. 7.
Figure 15:
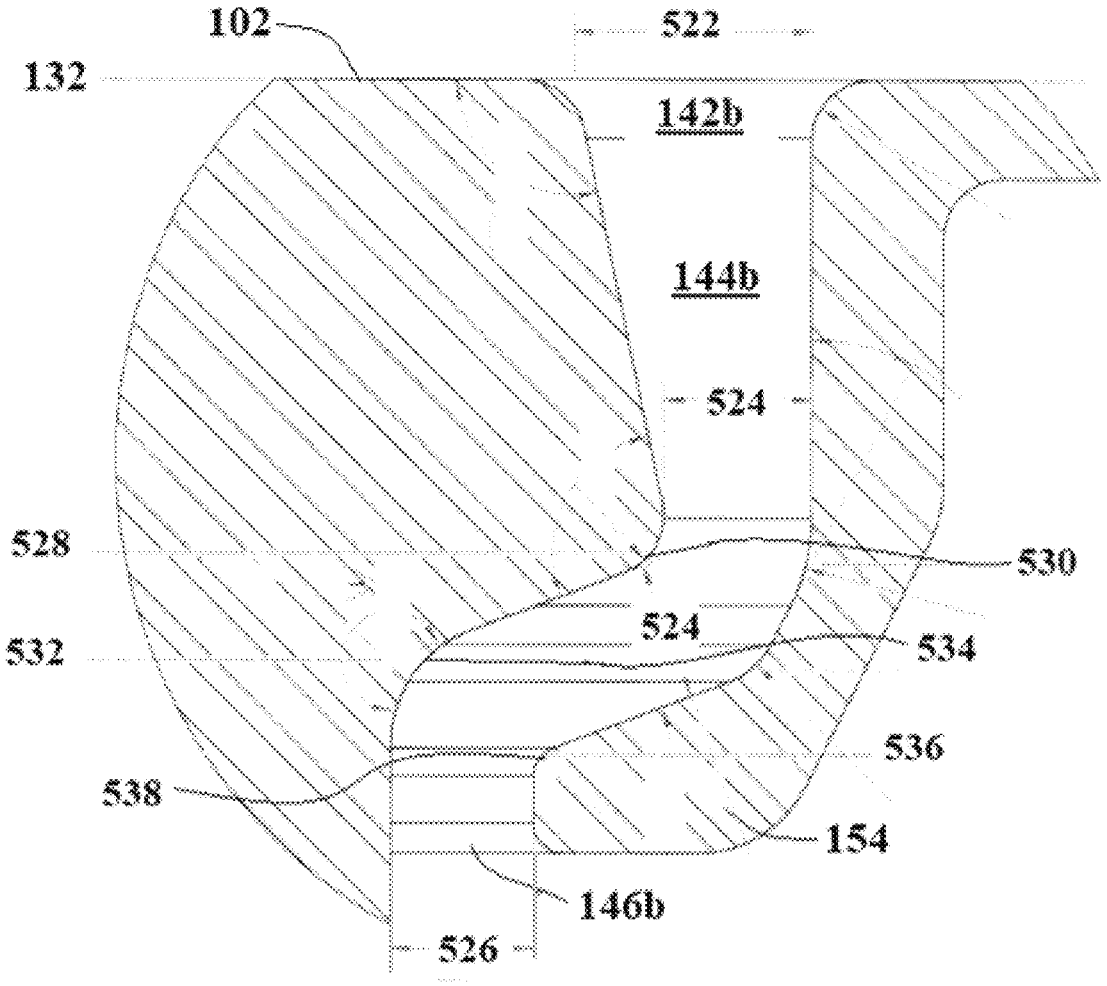
FIG. 15 is a detailed view of the cross-sectional area of circle B shown in FIG. 14.

FIG. 14 is a cross-sectional side view taken along line 11-11 of FIG. 7. FIG. 15 is a detailed view of the cross-sectional area of circle B shown in FIG. 14. FIG. 15 shows an exterior opening $142_b$ with exterior channel $144_b$ and exit $146_b$. Exterior opening $142_b$ has a width 522 of between 0.2 inches and 0.3 inches, specifically between 0.22 inches and 0.28 inches, and more specifically 0.25±0.1 inches. A channel width 524 defined by the minimum distance between opposing walls of channel $144_b$ is between 0.1 inches and 0.2 inches, specifically between 0.12 inches and 0.18 inches, and more specifically 0.14±0.1 inches. A width 526 of exit $146_b$ is shown to be between 0.1 inches and 0.2 inches, specifically between 0.12 inches and 0.18 inches, and more specifically 0.15±0.1 inches.

A depth 528 of a first bend 530, measured perpendicularly from top surface 132 towards exit 146, is between 0.40 inches and 0.60 inches, specifically between 0.45 inches and 0.55 inches, and more specifically is 0.50 inches±0.02 inches. Bends are any change in the direction of flow path 158 that is equal to greater than 60°. A depth 532 of a second bend 534 is between 0.60 inches and 0.65 inches, and specifically is 0.62 inches±0.01 inches. A depth 536 of a third bend 538 is between 0.65 inches and 0.75 inches, specifically between 0.68 inches and 0.72 inches, and more specifically, is 0.70 inches±0.01 inches. In some embodiments, exterior channel $144_b$ has at least three bends (e.g., 530, 534, and 538) within a depth of 0.70±0.01 inches. Applicant has found that by increasing the number of bends ligature prevention is enhanced by increasing resistance to a rope passing through channel 144, but without reducing the volume of water or other fluids that may pass through the channel 144 of drain assembly 100.

Figure 16:
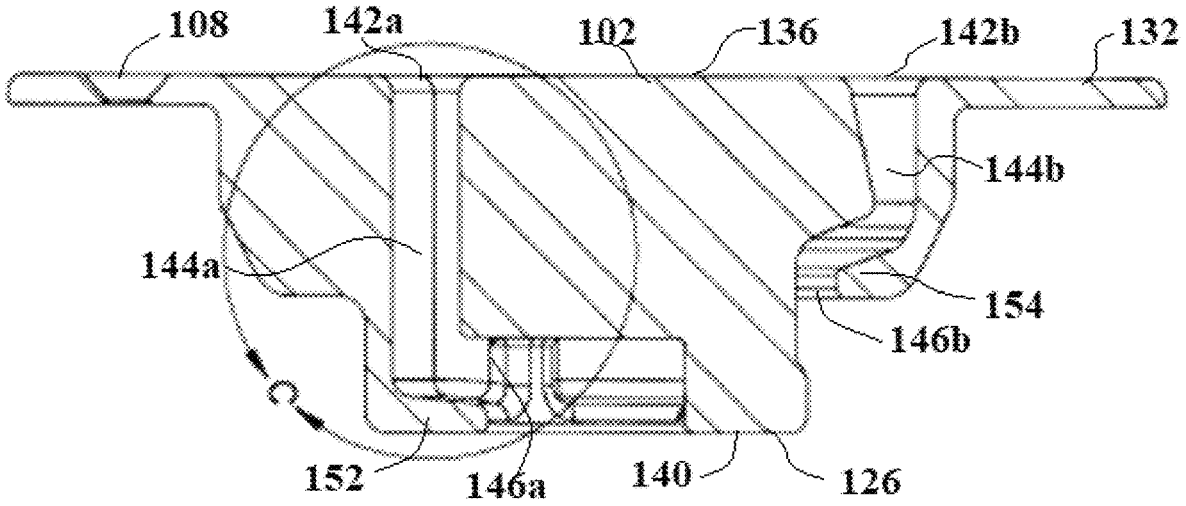
FIG. 16 is a cross-sectional side view taken along line 11-11 of FIG. 7.
Figure 17:
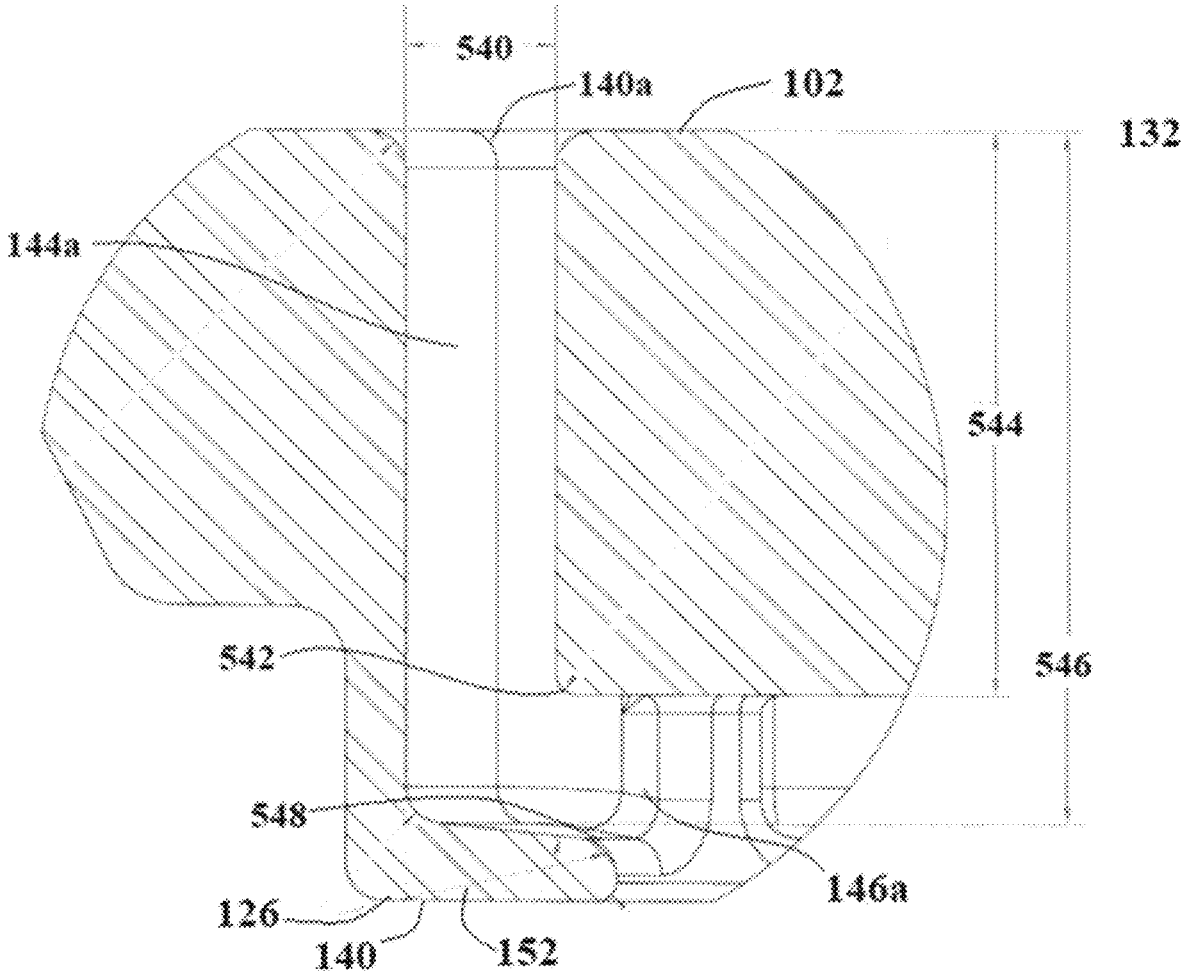
FIG. 17 is a detailed view of the cross-sectional area of circle C shown in FIG. 16.

FIG. 16 is a cross-sectional side view taken along line 11-11 of FIG. 7 and shows interior opening $142_a$, interior channel $144_a$, and interior exit $146_a$. FIG. 17 is a detailed view of the cross-sectional area of circle C shown in FIG. 16. Similar to FIG. 16, FIG. 17 shows interior opening $142_a$ with interior channel $144_a$ and exit $146_a$. In various embodiments, a width 540 of opening $142_a$ is equal to a width 540 of interior channel $144_a$ and/or exit $146_a$. Width 540 is between 0.10 inches and 0.30 inches, and specifically is between 0.14 inches and 0.26 inches, and more specifically is 0.25±0.1 inches. Interior channel $144_a$ has a first bend 542 at a first depth 544 between 0.80 and 1.10 inches, specifically between 0.90 and 1.00 inches, and specifically, 0.96±0.2 inches. A second bend 546 is located at a second depth 548 between 1.10 inches and 1.20 inches, specifically between 1.15 inches and 1.18 inches, and more specifically, is 1.17±0.2 inches.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths, and radii, as shown in the Figures, are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In various embodiments, the present disclosure extends to a variety of ranges (e.g., plus or minus 30%, 20%, or 10%) around any of the absolute or relative dimensions disclosed herein or determinable from the Figures.

What is claimed is:

1. A multi-channel, ligation resistant drain cover having a top side and a bottom side, the cover comprising:

a top plate including a top surface, a bottom surface, a periphery, a first interior fluid flow opening extending between the top and bottom surface, and a first exterior fluid flow opening extending between the top and bottom surface and located between the interior fluid flow opening and the periphery;

an exterior fluid guide wall extending from the bottom surface between the periphery and the exterior fluid flow opening, the exterior fluid guide wall including a first diverter wall displaced from the bottom surface and extending radially inward toward a central axis of the top plate at a first angle from the exterior fluid guide wall;

an intermediate fluid guide wall extending from the bottom surface between the interior and exterior flow openings, the intermediate fluid guide wall including a second diverter wall displaced from the bottom surface and extending radially inward toward the central axis of the top plate at a second angle from the intermediate fluid guide wall, the exterior and intermediate fluid guide walls being located to form a curved exterior fluid flow channel extending from the top surface, through the exterior fluid flow opening and exiting at the bottom side of the cover at an exterior exit; and an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at the bottom side of the cover at an interior exit separate from and displaced from the exterior exit.

2. The cover of claim 1, wherein the interior exit is located further from the bottom surface than the exterior exit.

3. The cover of claim 2, wherein the first diverter includes a first wall parallel with the top plate.

4. The cover of claim 3, wherein the second diverter includes a second wall parallel with the top plate and displaced from the first diverter wall.

5. The cover of claim 4, including at least a second interior flow opening, and two interior dividing walls extending between the intermediate fluid guide wall and the interior fluid guide wall to form two separate interior flow paths through the interior fluid flow channel associated with each of the interior flow openings.

6. The cover of claim 5, including at least a second exterior flow opening, and two exterior dividing walls extending between the intermediate fluid guide wall and the exterior fluid guide wall to form two separate exterior flow paths through the exterior fluid flow channel associated with each of the exterior flow openings.

7. The cover of claim 4, including at least second and third interior flow openings, and three interior dividing walls extending between the intermediate fluid guide wall and the interior fluid guide wall to form three separate interior flow paths through the interior fluid flow channel associated with each of the interior flow openings.

8. The cover of claim 5, including at least second and third exterior flow openings, and three exterior dividing walls extending between the intermediate fluid guide wall and the exterior fluid guide wall to form three separate exterior flow paths through the exterior fluid flow channel associated with each of the exterior flow openings.

9. The cover of claim 8, wherein the top plate is circular, the first diverter and the second diverter each include one or more arcuate portions, and the guide walls each include respective cylindrical portions.

10. The cover of claim 8, formed from cast stainless steel.

11. A multi-channel, ligation resistant drain assembly comprising:

an interface for creating a sealed fluid channel between a flow and a drainpipe, the interface including a flange for attachment to a floor surface, the flange being joined to a tubular portion for attachment to the drainpipe; and a drain cover including:

a top plate attachable to the flange and including a top surface, a bottom surface, a periphery, a first interior fluid flow opening extending between the top and bottom surface, and a first exterior fluid flow opening extending between the top and bottom surface and located between the interior fluid flow opening and the periphery;

an exterior fluid guide wall extending from the bottom surface between the periphery and the exterior fluid flow opening, the exterior fluid guide wall including a first diverter wall displaced from the bottom surface and extending radially inward toward the central axis of the top plate at a first angle from the exterior fluid guide wall;

an intermediate fluid guide wall extending from the bottom surface between the interior and exterior flow openings, the intermediate fluid guide wall including a second diverter wall displaced from the bottom surface and extending radially inward toward the central axis of the top plate at a second angle from the intermediate fluid guide wall, the exterior and intermediate fluid guide walls being located to form a curved exterior fluid flow channel extending from the top surface, through the exterior fluid flow opening and exiting at the periphery of the cover at an exterior exit; and an interior fluid guide wall extending from the bottom surface and cooperating with the intermediate fluid guide wall to form a curved interior fluid flow channel separate from the exterior fluid flow channel and extending from the top surface, through the interior fluid flow opening and exiting at a bottom side of the cover at an interior exit separate from and displaced from the exterior exit.

12. The assembly of claim 11, further comprising a plurality of tamper-resistant flat head screws that are inserted at a plurality of counter-sunk fastener holes of the cover and anchored in a plurality of threaded inserts in a drain body flange.

13. The assembly of claim 12, wherein the tamper-resistant flat head screws are anchored in pre-installed threaded inserts in the drain body flange, wherein the cover has fastener locations that are retrofit for an existing drain body.

14. The assembly of claim 12, further comprising at least three tamper-resistant flat head screws inserted into at least three counter-sunk fastener holes on the cover and anchored in three threaded inserts of the drain body flange.

15. The assembly of claim 11, including at least second and third interior flow openings, and three interior dividing walls extending between the intermediate fluid guide wall and the interior fluid guide wall to form three separate interior flow paths through the interior fluid flow channel associated with each of the interior flow openings.

16. The assembly of claim 15, including at least second and third exterior flow openings, and three exterior dividing walls extending between the intermediate fluid guide wall and the exterior fluid guide wall to form three separate exterior flow paths through the exterior fluid flow channel associated with each of the exterior flow openings.

17. The assembly of claim 16, wherein the top plate, the first diverter, and the second diverter are circular, and the guide walls each include respective cylindrical portions.

18. The assembly of claim 17 wherein the cover is formed from cast stainless steel, and the interface is formed from brass.

19. A multi-channel, ligation resistant drain cover having a top side and a bottom side, the cover comprising:

a circular top plate including a top surface, a bottom surface, a periphery, three interior fluid flow openings extending between the top and bottom surface, and three exterior fluid flow openings extending between the top and bottom surface and located between the interior fluid flow opening and the periphery;

an exterior fluid guide wall extending from the bottom surface between the periphery and the exterior fluid flow openings, the exterior fluid guide wall including a first diverter wall displaced from the bottom surface and extending radially inward toward the central axis of the top plate at a first angle from the exterior fluid guide wall;

an intermediate fluid guide wall extending from the bottom surface between the interior and exterior flow openings, the intermediate fluid guide wall including a second diverter wall displaced from the bottom surface and extending radially inward toward the central axis of the top plate at a second angle from the intermediate fluid guide wall, the exterior and intermediate fluid guide walls being located to form a curved exterior fluid flow channel extending from the top surface, through the exterior fluid flow openings and exiting at the bottom side of the cover at an exterior exit;

an interior fluid guide wall extending from the bottom surface and cooperating with the intermediate fluid guide wall to form a curved interior fluid flow channel separate from the exterior fluid flow channel and extending from the top surface, through the interior fluid flow openings and exiting at the bottom side of the cover at an interior exit separate from and displaced from the exterior exit;

three interior dividing walls extending between the intermediate fluid guide wall and the interior fluid guide wall to form three separate interior flow paths through the interior fluid flow channel associated with each of the interior flow openings; and three exterior dividing walls extending between the intermediate fluid guide wall and the exterior fluid guide wall to form three separate exterior flow paths through the exterior fluid flow channel associated with each of the exterior flow openings.

20. The cover of claim 19, wherein the interior exit is located further from the bottom surface than the exterior exit, the diverters each include one or more arcuate portions, and the cover is fabricated from stainless steel.

* * * * *